US005708323A

United States Patent [19]

Okamoto

[11] Patent Number: 5,708,323

[45] Date of Patent: Jan. 13, 1998

[54] COLOR CATHODE RAY TUBE

[75] Inventor: Hisakazu Okamoto, Kumagaya, Japan

[73] Assignee: Kabushiki Kaisha Toshiba, Kawasaki, Japan

[21] Appl. No.: 627,382

[22] Filed: Apr. 4, 1996

Related U.S. Application Data

[63] Continuation of Ser. No. 305,713, Sep. 14, 1994, abandoned.

[30] Foreign Application Priority Data

| | | | |
|---|---|---|---|
| Sep. 14, 1993 | [JP] | Japan | 5-228739 |
| Jan. 19, 1994 | [JP] | Japan | 6-003851 |
| Jul. 15, 1994 | [JP] | Japan | 6-162574 |

[51] Int. Cl.[6] ..... H01J 29/46

[52] U.S. Cl. ..... 313/431; 313/412

[58] Field of Search ..... 313/412, 428, 313/430, 431, 313; 335/212, 214

[56] References Cited

U.S. PATENT DOCUMENTS

| | | | |
|---|---|---|---|
| 4,310,776 | 1/1982 | Duys | 313/412 |
| 4,362,964 | 12/1982 | Sakurai et al. | 313/412 |
| 4,490,644 | 12/1984 | Shimoma et al. | 313/414 |
| 4,503,357 | 3/1985 | Ouhata et al. | 313/313 |
| 5,227,753 | 7/1993 | Hirai et al. . | |
| 5,384,513 | 1/1995 | Ji | 313/414 |
| 5,397,969 | 3/1995 | Roussel et al. | 315/382 |

FOREIGN PATENT DOCUMENTS

| | | |
|---|---|---|
| 0633598 | 1/1995 | European Pat. Off. . |
| 633598 | 1/1995 | European Pat. Off. . |
| 1255136 | 10/1989 | Japan . |
| 4-24250 | 2/1992 | Japan . |
| 4315737 | 11/1992 | Japan . |
| 721938 | 1/1995 | Japan . |

*Primary Examiner*—Sandra L. O'Shea
*Assistant Examiner*—Vip Patel
*Attorney, Agent, or Firm*—Cushman Darby & Cushman, IP Group of Pillsbury Madison & Sutro, LLP

[57] ABSTRACT

A phosphor screen comprising three color phosphor layers that emit red, green, and blue light is provided on the inner surface of a panel of an envelope, and an in-line type electron gun assembly for emitting three electron beams aligned on the same axis (generally a horizontal axis X) is mounted in a neck. This electron gun assembly has three cathodes arranged in a row, and a plurality of electrodes for sequentially focusing and accelerating the electron beams from the respective cathodes toward the phosphor screen. A pair of belt-like magnetic segments are provided on the outer wall of the neck of the envelope to serve as magnetic members for adjusting an external magnetic field. Each magnetic segment is made of a hot-rolled silicon steel plate having a thickness of 0.35 mm, a width of 4 mm, and a length of 40 mm in the direction of the tube axis. The magnetic segments are arranged such that their centers in the longitudinal direction correspond to the cathodes on an electron beam alignment plane, and extend in the back-and-forth direction of the tube axis each by 20 mm about the cathodes as the center. By these magnetic segments, a change in convergence caused by the external magnetic field can be suppressed.

14 Claims, 10 Drawing Sheets

COLOR CATHODE RAY TUBE

This is a continuation of application Ser. No. 08/305,713, filed on Sep. 14, 1994, which was abandoned.

BACKGROUND OF THE INVENTION

1. Field of the Invention

The present invention relates to a color cathode ray tube and, more particularly, to an in-line type color cathode ray tube having improved convergence characteristics.

2. Description of the Related Art

Generally, as shown in FIG. 1, an in-line type color cathode ray tube has an envelope constituted by a panel 1 and a funnel 2 continuous to the panel 1. A phosphor screen comprising three color phosphor layers that emit red, green, and blue light, i.e., a screen 7 is formed on the inner surface of the panel 1, and a shadow mask (not shown) is disposed to closely oppose the phosphor screen 7. An in-line type electron gun assembly 6 that emits three electron beams 5B, 5G, and 5R aligned on the same axis (generally, a horizontal axis X) is incorporated in a neck 3 of the funnel 2. A deflecting unit 4 is mounted on the outer portion of a region extending from the funnel 2 to the neck 3. A multipole field generating means PM for generating a multipole field is mounted on the outer circumferential surface of the neck 3. The three electron beams 5B, 5G, and 5R emitted from the electron gun assembly 6 are adjusted by the multipole field generating means PM so that high color purity and convergence can be obtained at the center of the screen. When the three electron beams 5B, 5G, and 5R are deflected by the deflecting unit 4 to scan the screen, a color image is reproduced on the phosphor screen 7.

Usually, as shown in FIGS. 2A and 2B, the in-line type electron gun assembly 6 has three cathodes 10B, 10G, and 10R, and a plurality of electrodes 11. The three cathodes 10B, 10G, and 10R have heaters inserted therein and are aligned in a row. The plurality of electrodes 11 sequentially control, focus, and accelerate the electron beams emitted from the cathodes 10B, 10G, and 10R toward the phosphor screen. The electrodes 11 are integrally fixed together with the three cathodes 10B, 10G, and 10R by an insulating support 12. Each of the cathodes 10B, 10G, and 10R is constituted by at least a cathode sleeve 13 having a cathode element provided with an electron emitting portion at one end portion thereof, a cathode cylinder 14 serving as a holding member for holding the cathode sleeve 13, and a cathode strap 15 provided on the outer circumferential surface of the cathode cylinder 14 to surround it by about half its circumference. The two ends of the cathode strap 15 are integrally fixed to the insulating support 12 together with other electrodes. In a large number of electron gun assembly, the electrodes 11 are made of a non-magnetic material, while a magnetic material is usually used to form the cathode cylinder 14 and the cathode strap 15.

The deflecting unit 4 has a pair of saddle type horizontal deflecting coils and a pair of saddle type vertical deflecting coils. The horizontal deflecting coils generate a pin-cushion type deflecting magnetic field, and the vertical deflecting coils generate a barrel type deflecting magnetic field. When the above in-line type electron gun assembly is combined with the deflecting unit that generates a non-uniform magnetic field, the three electron beams 5B, 5G, and 5R emitted from the electron gun assembly can be converged on the phosphor screen 7 formed on the inner surface of the panel 1, thereby achieving so-called self convergence.

With the in-line type color cathode ray tube having the above structure, the three electron beams can be easily converged on and throughout the entire area of the screen, so that the structure of the color cathode ray tube can be simplified. Therefore, in-line type color cathode ray tubes are widely used.

However, in the in-line type color cathode ray tube as described above, since the magnetic material is used in the cathode portion of the electron gun assembly, this portion may be undesirably influenced by the external magnetic field. For example, in the cathode 10G for emitting a center beam in the in-line type electron gun assembly shown in FIGS. 2A and 2B, the cathode strap 15 is not symmetrical with respect to the central axis. Also, in each of the cathodes 10B and 10R for emitting side beams, only half the circumference of the cathode cylinder 14 and part of the cathode strap 15 are present on sides opposite to the central cathode 10G, whereas the remaining half the circumference of the cathode cylinder 14 and most of the cathode strap 15 are present on the central cathode 10G sides. In this manner, in the cathodes 10B and 10R located on the two sides of the cathode 10G, the amounts of the magnetic material arranged on the right and left sides of the central line often differ. Due to this non-uniformity in amounts of the magnetic material of the cathodes arranged on the alignment axis, when geomagnetic components in the direction of the tube axis are applied, red and blue display images are often vertically deviated in the opposite directions, as shown in FIG. 3.

This change in convergence typically occurs when the display monitor is arranged in a direction different from a direction in which the display monitor has been arranged for adjustment of the in-line type color cathode ray tube, and when the in-line type color cathode ray tube is used in a local area having different geomagnetic conditions from that in above adjustment.

In the case of an in-line type color cathode ray tube used as a display, a convergence error amount of 0.3 mm or less is required as the image quality. Therefore, erroneous convergence as described above poses a serious problem.

Jpn. Pat. Appln. KOKAI Publication No. 4-315737 and Jpn. UM Appln. KOKAI Publication No. 4-24250 disclose arrangements of a cylindrical magnetic body outside the neck portion. However, even by using this means, it is difficult to suppress erroneous convergence as described above.

SUMMARY OF THE INVENTION

It is an object of the present invention to provide an in-line type color cathode ray tube capable of suppressing erroneous convergence caused by the geomagnetism.

In order to solve the above problem, according to the present invention, there is provided a color cathode ray tube comprising a phosphor screen formed on the inner surface of the panel of an envelope, and an electron gun assembly, opposing the phosphor screen, for emitting a plurality of electron beams arranged in a row, wherein the color cathode ray tube has at least a pair of magnetic members elongated in the direction of a tube axis at outer sides of the electron gun assembly on an electron beam alignment plane.

There is also provided a color cathode ray tube comprising a phosphor screen formed on the inner surface of the panel of an envelope, and an in-line type electron gun assembly, which opposes the phosphor screen and is constituted by at least three cathodes arranged in a row, and a plurality of electrodes arranged on a phosphor screen side of the cathodes, for emitting three electron beams, wherein the color cathode ray tube has a pair of magnetic members for adjusting a component of an external magnetic field in the direction of a cathode alignment axis, that acts, of the three electron beams, on side beams in the vicinity of the cathodes.

The color cathode ray tube comprises first magnetic members elongated in the direction of the tube axis, and a second magnetic member arranged in the vicinity of the multipole field generating plates of a multipole field generating means.

The first and second magnetic members may be arranged at the neck of the color cathode ray tube.

Also, according to the present invention, the first and second magnetic members are integrally provided to the multipole field generating means mounted on the color cathode ray tube.

At this time, the first magnetic members are provided to the cylindrical holder of the multipole field generating means, and the second magnetic member is provided to the dividing spacers of the multiple field generating means.

According to the present invention, the pair of first magnetic members are arranged on the opposite sides to the center beam with respect to the axes of the side beams on an electron beam alignment plane. When the first magnetic members are arranged, the size and direction of a component of the external magnetic field in the direction of the cathode alignment axis can be adjusted.

More specifically, of external magnetic fields represented by the geomagnetism entering from the panel side (or neck side) of the envelope, a magnetic field passing at outer sides in the direction of the cathode alignment axis, i.e., a magnetic field passing at outer sides of a region corresponding to the gap between the two side cathodes, is concentrated on the first magnetic members. Also, a magnetic field which passes among a cathode located at the center and the cathodes located at the two sides and is concentrated on the center cathode side is changed in a direction to be concentrated by the first magnetic members. Therefore, generation of a magnetic field component perpendicularly intersecting the electron beam track in the vicinity of the cathodes can be suppressed, and generation of an electromagnetic force (Lorentz force) that serves to move the pair of side beams in opposite directions can be suppressed, thereby suppressing erroneous convergence.

The second magnetic member arranged in the vicinity of the multipole field generating plates of the multipole field generating means which is mounted on the neck of the color cathode ray tube balances the amounts of the magnetic materials arranged in the vicinity of the multipole field generating magnet plates, thereby suppressing a magnetic field generated by the multipole field generating means from being influenced by the first magnetic members.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 2A and 2B are views showing the main part of an electron gun assembly, in which FIG. 2A is a schematic perspective view showing cathodes and electrodes close to them, and FIG. 2B is a sectional view of a cathode portion seen from the direction of a tube axis;

FIGS. 6A and 6B are graphs each showing the distribution of the magnetic field to explain the operation of the magnetic members shown in FIG. 5, in which FIG. 6A shows the case of the color cathode ray tube according to the present invention in which magnetic members are arranged, and FIG. 6B shows the case of a conventional color cathode ray tube;

DETAILED DESCRIPTION OF THE PREFERRED EMBODIMENTS

The color cathode ray tubes according to the preferred embodiments of the present invention will be described with reference to the accompanying drawings.

(First Embodiment)

Figure 1:
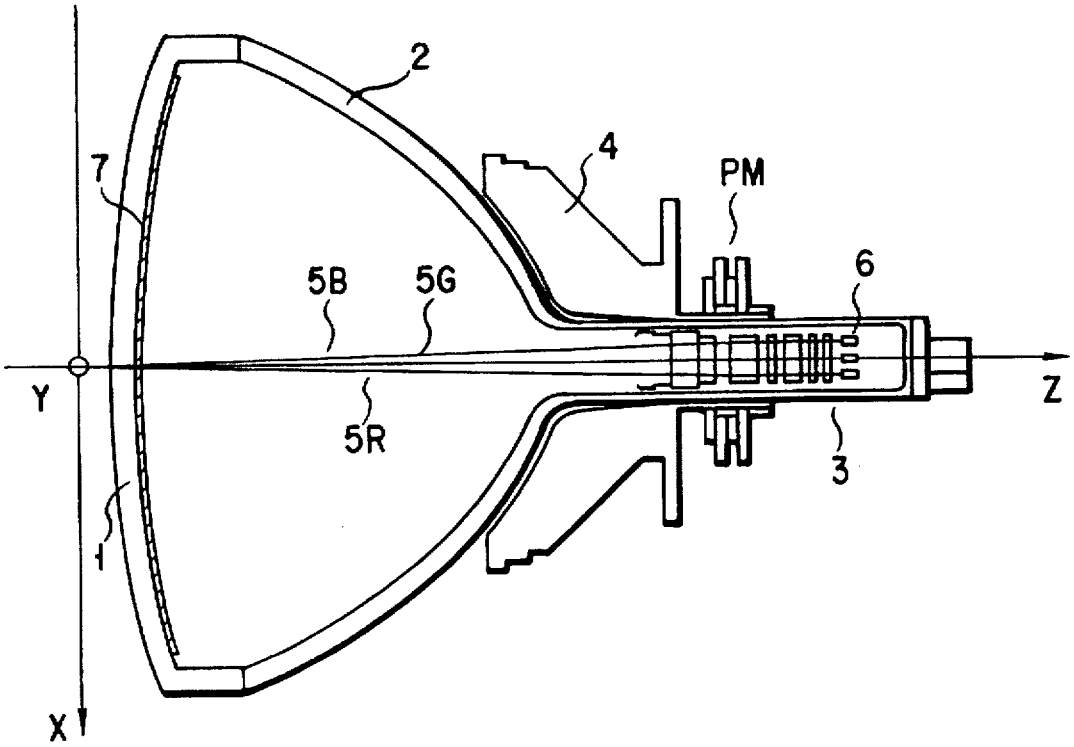
F I G. 1 (PRIOR ART)
FIG. 1 is a sectional view schematically showing a conventional in-line type color cathode ray tube.
Figure 3:
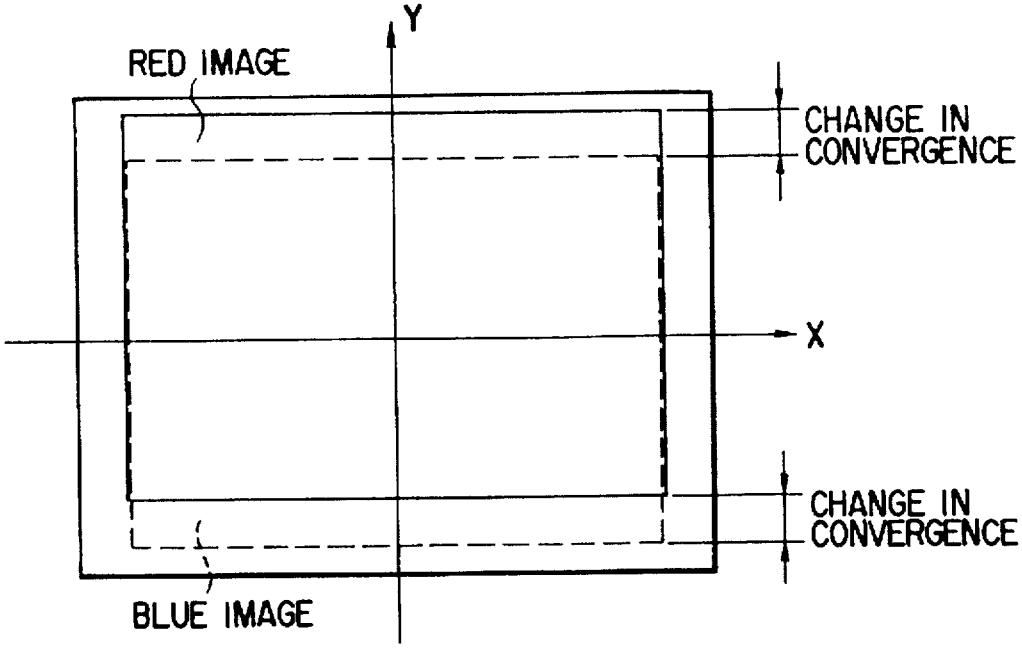
F I G. 3 (PRIOR ART)
FIG. 3 is a diagram showing erroneous convergence of the color cathode ray tube shown in FIG. 1.
Figure 2A:
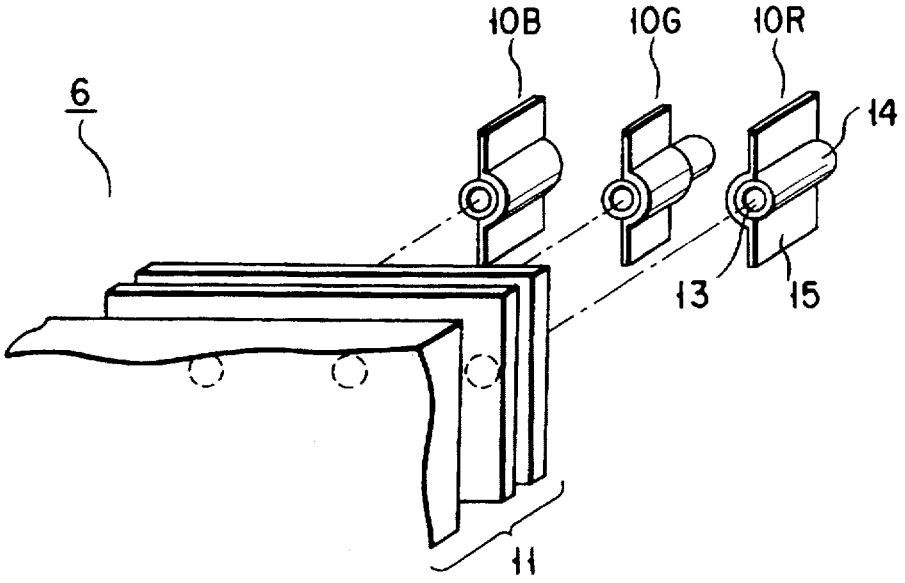
F I G. 2A (PRIOR ART)
Figure 2B:
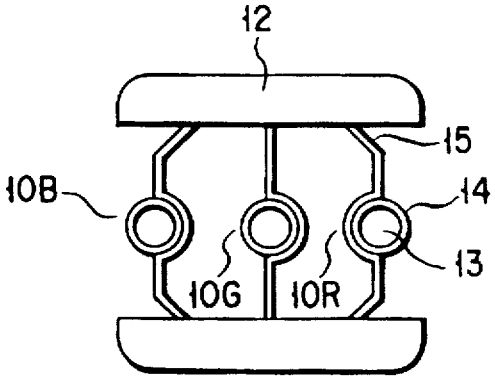
F I G. 2B (PRIOR ART)
Figure 4:
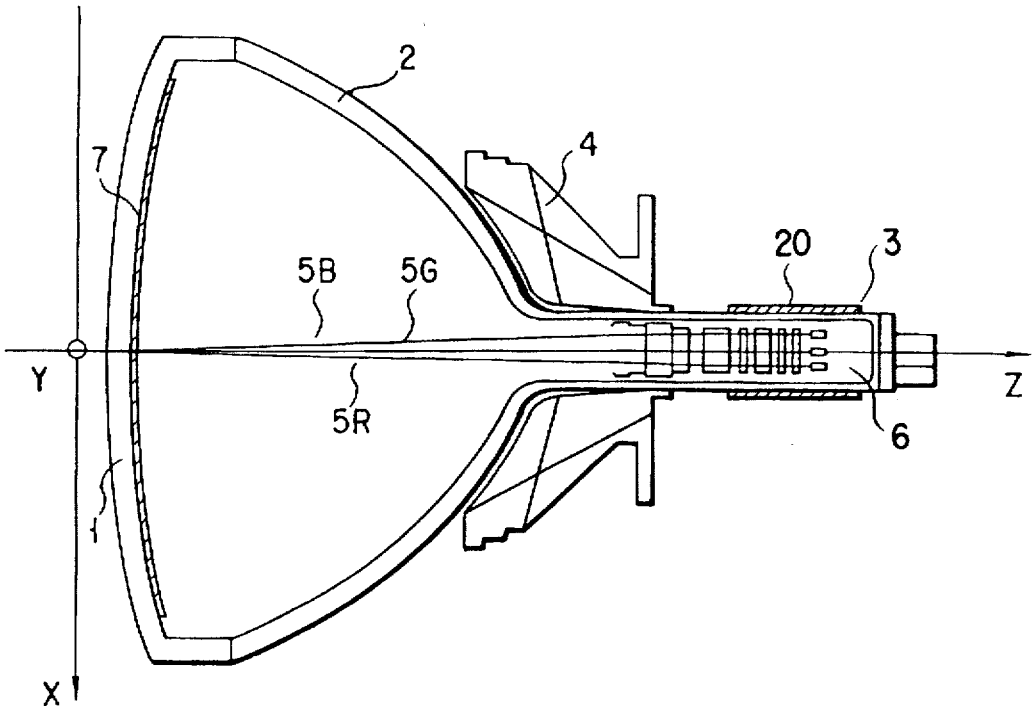
FIG. 4 is a sectional view schematically showing an in-line type color cathode ray tube according to an embodiment of the present invention.
Figure 5:
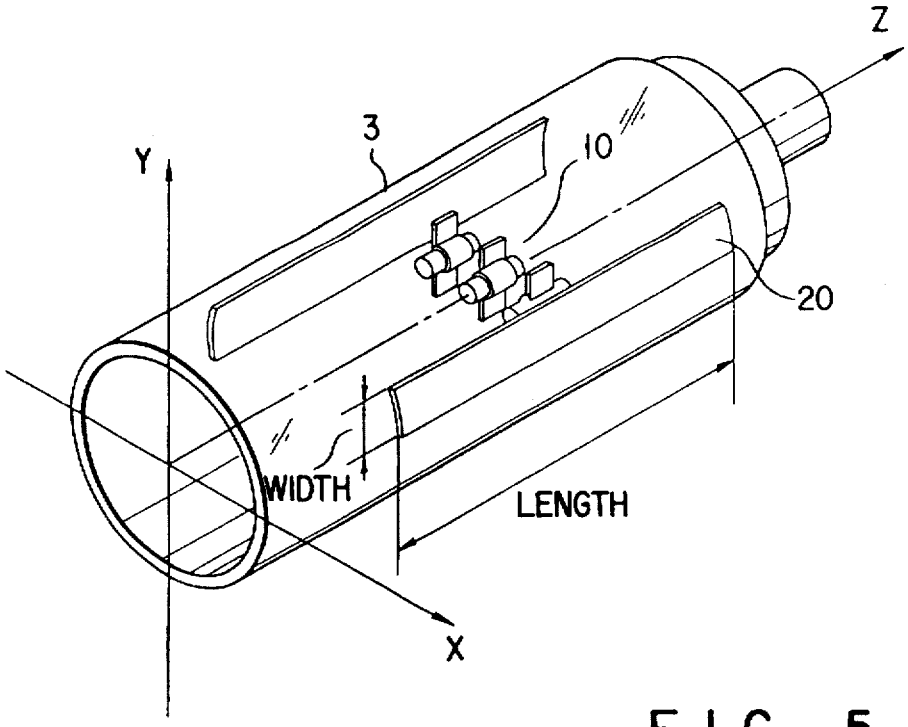
FIG. 5 is a schematic perspective view showing a neck portion shown in FIG. 4, in which the arrangement of magnetic members is indicated.

FIGS. 4 and 5 show a color cathode ray tube according to the first embodiment of the present invention. The color cathode ray tube of this embodiment has an envelope constituted by a panel 1 and a funnel 2 continuous to the panel 1. A phosphor screen 7 comprising three color phosphor layers that emit red, green, and blue light is formed on the inner surface of the panel 1. A shadow mask (not shown) is disposed to closely oppose the phosphor screen 7. An in-line type electron gun assembly 6 for emitting three electron beams 5R, 5G, and 5B aligned on the same axis (generally a horizontal axis X) is mounted in a neck 3 of the funnel 2. A deflecting unit 4 is mounted on the outer portion of a region extending from the funnel 2 to the neck 3. The deflecting unit 4 consists of a pair of saddle type horizontal deflecting coils and a pair of saddle type vertical deflecting coils, in the same manner as in the conventional deflecting unit. The horizontal deflecting coils generate a pin-cushion type deflecting magnetic field, and the vertical deflecting coils generate a barrel type deflecting magnetic field as in the conventional deflecting unit.

The electron gun assembly 6 has three cathodes 10 and a plurality of electrodes. The three cathodes 10 have heaters inserted therein and are arranged in a row. The plurality of electrodes sequentially control, focus, and accelerate the electron beams emitted from the cathodes 10 toward the phosphor screen. The electrodes are integrally fixed together with the three cathodes 10 by an insulating support. Each cathode is constituted by at least a cathode sleeve serving as a cathode element provided with an electron emitting portion at one end portion thereof, a cathode cylinder serving as a holding member for holding the cathode sleeve, and a cathode strap provided on the outer circumferential surface of the cathode cylinder to surround it by about half its circumference. The two ends of the cathode strap are integrally fixed to the insulating support together with other electrodes. The electrodes of the electron gun assembly are made of a non-magnetic material, while a magnetic material is used to form the cathode strap.

A pair of belt-like magnetic segments 20 are disposed on the outer wall of the neck 3 of the envelope to serve as the magnetic members for adjusting the external magnetic field. Each magnetic segment 20 is made of a hot-rolled silicon steel plate having a thickness of 0.35 mm, a width of 4 mm, and a length of 40 mm in the direction of the tube axis. The longitudinal direction of the magnetic segment 20 extends along the tube axis on an X-Z plane serving as an electron beam alignment plane. The magnetic segments 20 are arranged such that their centers in the longitudinal direction extend through the cathodes 10, and the magnetic segments 20 extend in the direction of the tube axis forward and backward each by 20 mm about the cathodes 10 as the center.

Figure 6A:
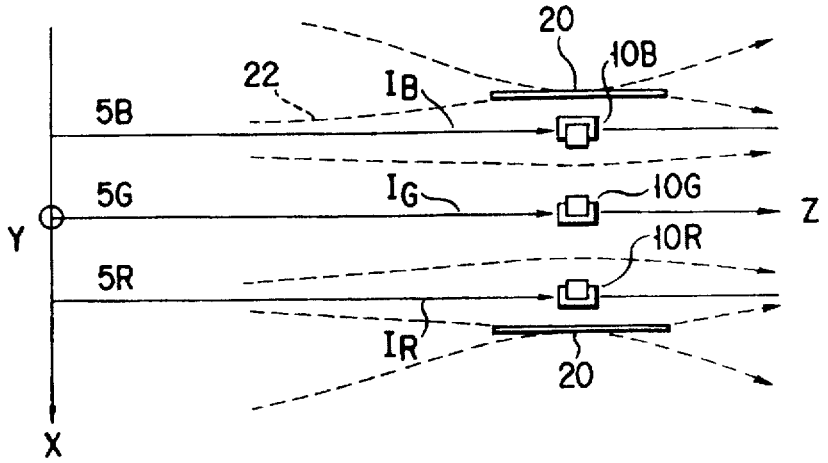
Figure 6B:
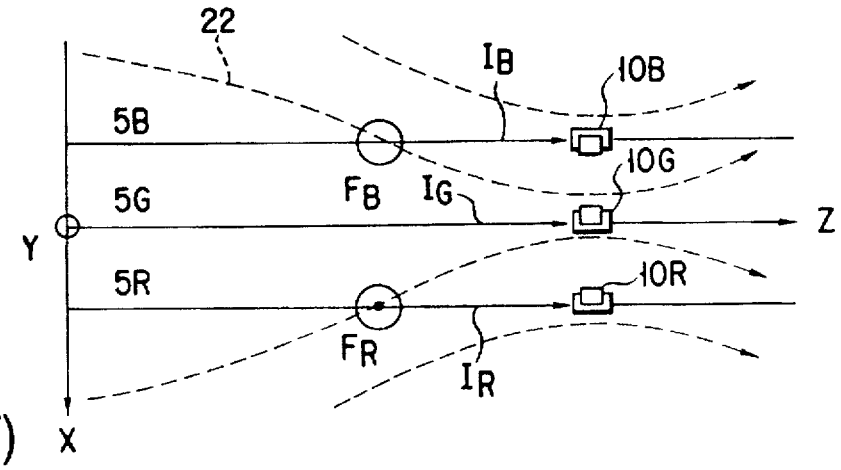
F I G. 6B (PRIOR ART)

The operation of the magnetic members of the cathode ray tube according to the embodiment of the present invention which has the magnetic members will be described with reference to FIGS. 6A and 6B in comparison with a conventional color cathode ray tube having no magnetic member. FIG. 6A shows this embodiment, and FIG. 6B shows the conventional cathode ray tube. Both FIGS. 6A and 6B show a case wherein a DC magnetic field (0.3 gauss) passing from the panel side toward the neck is applied to an in-line type color cathode ray tube adjusted in the absence of a magnetic field. This corresponds to a geomagnetic state obtained in Japan when the color cathode ray tube is arranged such that its panel faces south. Referring to FIGS. 6A and 6B, solid arrows $I_B$, $I_G$, and $I_R$ indicate the electron beams 5B, 5G, and 5R as the directions of the current, and broken arrows 22 indicate geomagnetism as the external magnetic field.

As described above, when the cathode portion of the electron gun assembly of the conventional in-line type color cathode ray tube is seen from the panel side, the amounts of magnetic material often differ on the right and left sides of the central lines of the cathodes 10B and 10R located on the two sides. For example, only half the circumference of the cathode cylinder and part of the cathode strap are present on outer sides of the centers of the two side electron beams 5B and 5R, whereas remaining half the circumference of the cathode cylinder and most of the cathode strap of the central cathode 10R are present on the center beam 5G sides. In this case, as shown in FIG. 6B, the geomagnetism 22 entering from the panel side of the cathode ray tube is concentrated on the central cathode 10G. At this time, the Lorentz force given to the electron beams by the geomagnetic components directed to the central cathode 10G is upward (indicated by $F_R$ in FIG. 6B) with respect to the red electron beam 5R and downward (indicated by $F_B$ in FIG. 6B) with respect to the blue electron beam 5B, thus being asymmetrical between red and blue. As a result, a convergence change occurs in which the red and blue images are deviated upward and downward, respectively, with respect to the green image as the center, resulting in degradation of image quality.

In contrast to this, in the color cathode ray tube of this embodiment shown in FIG. 6A which has magnetic members, when compared to the conventional color cathode ray tube shown in FIG. 6B which has no magnetic member, cathodes and magnetic members are provided on the electron beam alignment plane. Thus, the geomagnetism entering from the panel side is concentrated by the magnetic segments 20 and guided to a portion behind the cathodes. Also, the magnetic field, extending among the two side cathodes 10B and 10R and the central cathode 10R and concentrated on the central cathode 10G side, is changed in a direction to be concentrated by the magnetic segments 20, and the geomagnetic components perpendicularly intersecting the electron beam tracks are greatly reduced. As a result, generation of the unnecessary electromagnetic force (Lorentz force) to be applied on the electron beams is substantially eliminated.

Table 1 shows data obtained by comparison of this embodiment with the conventional case. In Table 1, a change in convergence, which is obtained when a magnetic field of 0.3 gauss is applied from the panel side after convergence adjustment of the color cathode ray tube is performed in the absence of a magnetic field, is shown. As shown in Table 1, a change in convergence can be suppressed by this embodiment.

TABLE 1

| | Amount of Change in Convergence (mm) | | | |
|---|---|---|---|---|
| | Central Portion of Screen | Veritcal End Portion of Screen | Horizontal End Portion of Screen | Diagonal End Portion of Screen |
| This Embodiment | 0.03 | 0.03 | 0.03 | 0.03 |
| Prior Art | 0.13 | 0.15 | 0.10 | 0.13 |

Figure 7A:
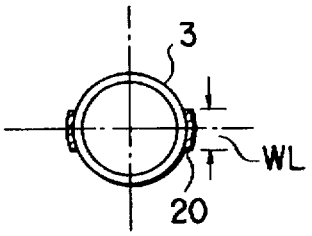
FIG. 7A is a sectional view showing how the magnetic members are arranged on the neck.
Figure 7B:
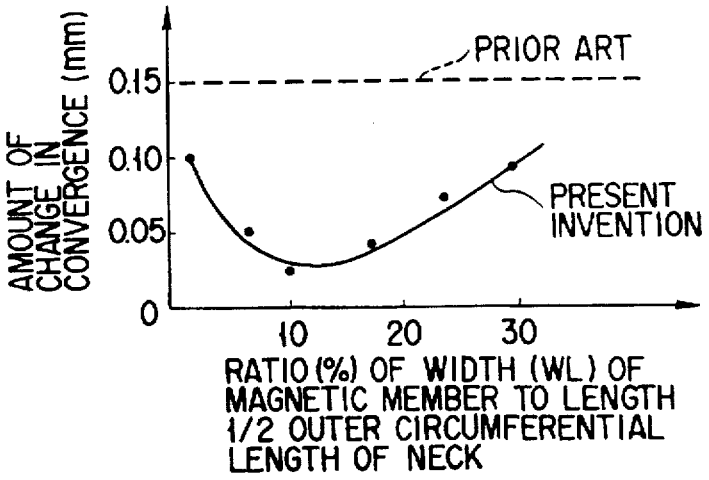
FIG. 7B is a graph showing a change in convergence with respect to the size of the magnetic members in this arrangement and, more particularly, a graph showing a case wherein the width of the magnetic members is changed.

The convergence change suppressing effect obtained by the magnetic members according to the present invention is also influenced by the shape, location, and the like of the magnetic members. FIGS. 7A and 7B, and 8A and 8B show the result of studies concerning influences given by the shape, and FIGS. 9A and 9B show influences given by the location. In FIGS. 7A and 7B, the amount of change in convergence, which is obtained when the ratio of a width WL of the magnetic members to ½ the outer circumferential length of the neck is changed, is measured. At this time, the length of the magnetic members in the direction of the tube axis is fixed at 30 mm. From FIGS. 7A and 7B, it is known that the convergence change suppressing effect is large when the ratio falls within the range of 25% to 10%. Note that the effect is decreased when the width is excessively large. The fact that the correction effect is inversely decreased in this manner when the width WL (size in the circumferential direction of the neck in this embodiment) of the magnetic members is excessively large is supposed to be caused by the following reason. Namely, when the magnetic members extend up to the upper and lower portions of the cathode alignment axis, the geomagnetism is also attracted to the upper and lower portions of the magnetic members, so that the force of the magnetic members to attract the components of the geomagnetism in the direction of the cathode alignment axis is relatively weakened.

Figure 8A:
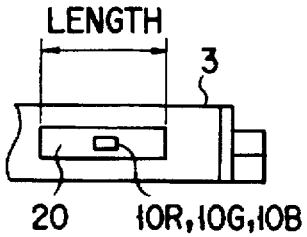
FIG. 8A is a side view showing how the magnetic material is arranged on the neck.
Figure 8B:
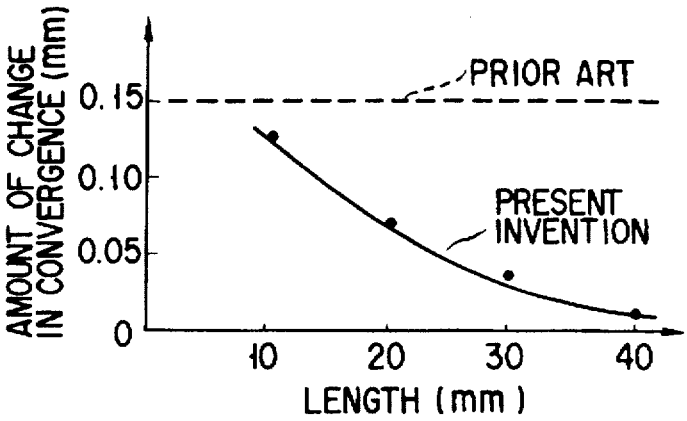
FIG. 8B is a graph showing a change in convergence with respect to the size of the magnetic members in this arrangement and, more particularly, a graph showing a case wherein the length of the magnetic members in the direction of the tube axis is changed.
Figure 9A:
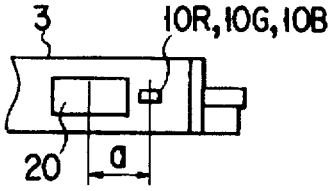
FIG. 9A is a side view showing how the magnetic members are arranged on the neck.
Figure 9B:
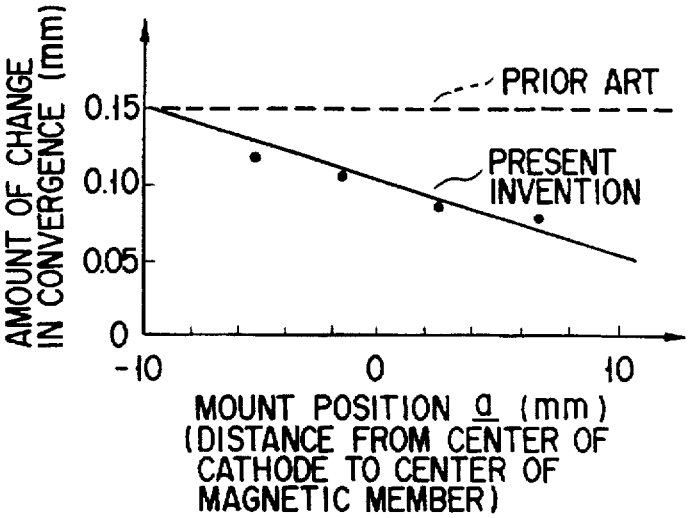
FIG. 9B is a graph showing a change in convergence caused when the positions of the magnetic members are changed in this arrangement.

In FIGS. 8A and 8B, the amount of change in convergence, obtained when a length L of the magnetic members in the direction of the tube axis is changed, is measured. At this time, the width of the magnetic members is fixed at 4 mm, and the magnetic members are arranged such that their lengths in front of and behind the cathode as the center become equal. From FIGS. 8A and 8B, it is known that the length L of the magnetic members in the direction of the tube axis is preferably long.

In FIGS. 9A and 9B, the change in convergence, obtained when the locations of the magnetic members with respect to the cathode are changed, is measured. At this time, the size of each magnetic member is fixed to have a width of 5 mm, a length of 25 mm, and a thickness of 0.35 mm, and a distance a of the center of each cathode from the center of each magnetic member is plotted along the axis of abscissa. From FIGS. 9A and 9B, it is known that the more the magnetic members are located on the panel side with respect to the cathodes, the smaller the change in convergence.

In this manner, the magnetic members located on the outer sides of the two side cathodes serve to adjust the components of the geomagnetism in the direction of the cathode alignment axis when an external magnetic field is applied. Therefore, the size and location of the magnetic members may be appropriately determined in units of the electron gun assemblies to be employed such that the operation of the magnetic members is balanced with respect to the axes of the two side electron beams as the centers.

In this embodiment, the magnetic members are arranged on the outer wall of the neck. However, the positions of the magnetic members are not limited to the outer wall of the neck. It suffices if they are located on the outer sides of the cathodes on the cathode alignment axis.

Furthermore, the magnetic members shown in this embodiment can be applied to any color cathode ray tube having an in-line type electron gun assembly, and the structure of the color cathode ray tube is not limited to that described in this embodiment.

(Second Embodiment)

Figure 10A:
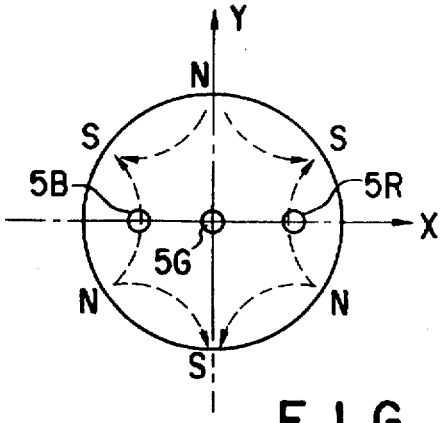
FIGS. 10A and 10B are main part schematic diagrams for explaining the influence on a multipole field generating means caused by the magnetic members shown in FIG. 5.
Figure 10B:
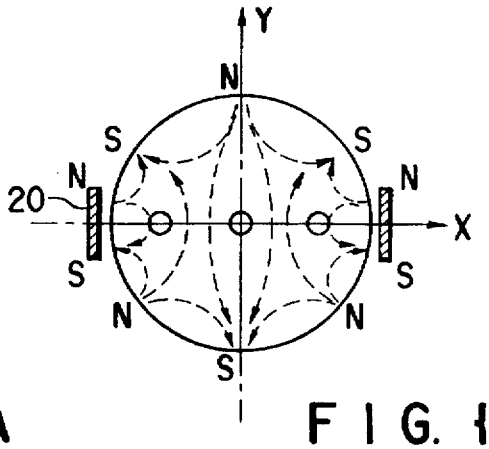

In the first embodiment, when the effect to suppress erroneous convergence caused by the geomagnetism is to be made effective, the length of the magnetic segments 20 in the direction of the tube axis is increased, and the magnetic segments 20 sometimes extend up to positions close to the multipole field generating means PM mounted on the neck portion. In this case, when concentration of the electron beams 5B, 5G, and 5R is to be adjusted by using, e.g., the multipole field generating means serving as the convergence adjusting unit that generates a multipole field as shown in FIG. 10A, the magnetic segments 20 are magnetized by the multipole field generating means, as shown in FIG. 10B, and as a result, the color purity of the electron beams and adjustment of convergence at the center of the screen by means of the multipole field generating means are sometimes adversely influenced.

According to this embodiment, an arrangement of a color cathode ray tube is provided, in which the correcting operation of the multipole field generating means will not be influenced even when magnetic members as a countermeasure for erroneous convergence caused by the geomagnetism are arranged.

Figure 11:
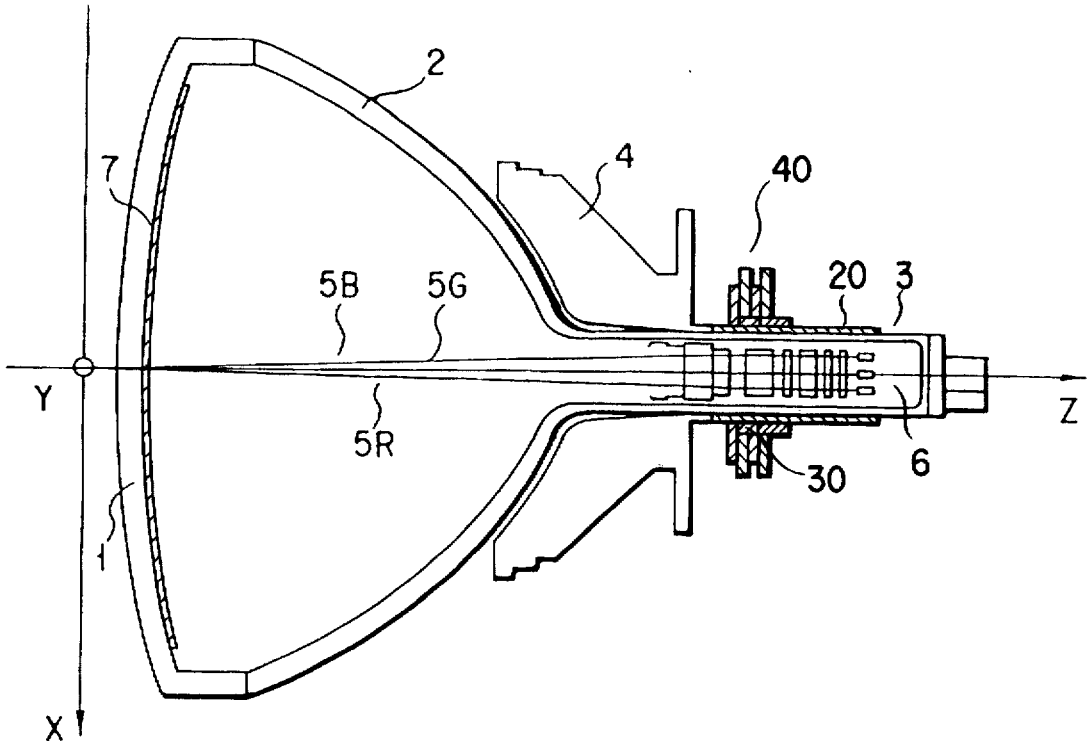
FIG. 11 is a sectional view showing an in-line type color cathode ray tube according to another embodiment of the present invention.
Figure 12:
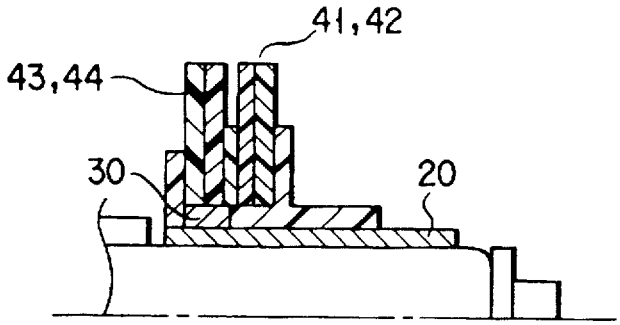
FIG. 12 is an enlarged schematic view of the neck portion shown in FIG. 11.
Figure 13:
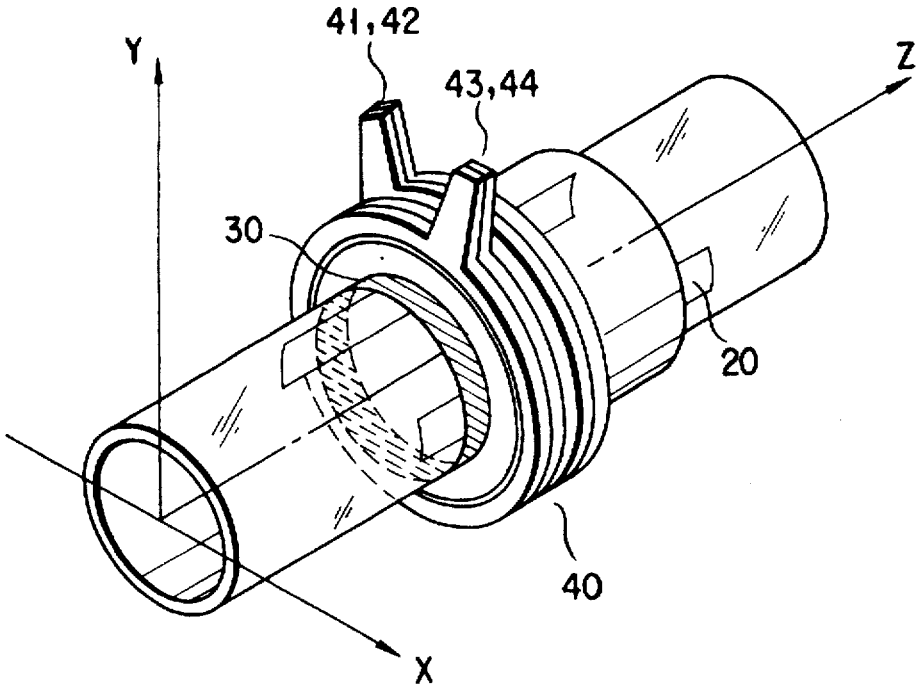
FIG. 13 is a schematic view showing the neck portion shown in FIG. 11 and, more particularly, a schematic perspective view showing the arrangement of the magnetic members.

The second embodiment of the present invention will be described with reference to the accompanying drawings. FIGS. 11 to 13 show the arrangement of a color cathode ray tube according to this embodiment, in which FIG. 11 is a sectional view of the color cathode ray tube according to this embodiment, FIG. 12 is an enlarged view of the main portion of the neck portion, and FIG. 13 is a schematic view showing the arrangement of the magnetic members.

The entire arrangement of the color cathode ray tube according to this embodiment is the same as that of the first embodiment, and thus a detailed description thereof will be omitted. As shown in FIGS. 11 and 12, a multipole field generating means 40 is arranged on the outer side of a neck 3. A pair of magnet plates 41 and 42 constituting a four-pole unit and a pair of magnet plates 43 and 44 constituting a six-pole unit are incorporated in the multipole field generating means 40. Furthermore, a deflecting unit 4 is mounted on the outer surface of a region extending from a funnel 2 to the neck 3. The deflecting unit 4 and an electron gun assembly 6 have the same arrangements as those of the first embodiment.

A pair of belt-like magnetic segments 20 serving as the first magnetic members are provided on the outer wall of the neck 3 of the envelope to adjust the external magnetic field, in the same manner as in the first embodiment. Each magnetic segment 20 is made of a hot-rolled silicon steel plate having a thickness of 0.35 mm, a width of 4 mm, and a length of 40 mm in the direction of the tube axis. The longitudinal direction of the magnetic segment 20 extends along the tube axis on an X-Z plane serving as an electron beam alignment plane. The magnetic segments 20 are arranged such that their centers in the longitudinal direction correspond to the positions of cathodes 10, and extend in the back-and-forth direction of the tube axis each by 20 mm about the cathodes 10 as the center.

An annular magnetic segment 30 serving as the second magnetic member is provided between the outer surface of the neck and the six-pole unit constituted by the pair of magnet plates 43 and 44 of the multipole field generating means 40. The annular magnetic segment 30 is made of a hot-rolled silicon steel plate having a thickness of 0.35 mm and a width of 4 mm, and extends on the outer circumference of the neck by one turn.

The operation of the magnetic members of this embodiment will be described. The operation of the first magnetic segments 20 is the same as that of the first embodiment, as shown in FIGS. 6A and 6B, and thus a detailed description thereof will be omitted. The second magnetic member will be described.

Figure 14:
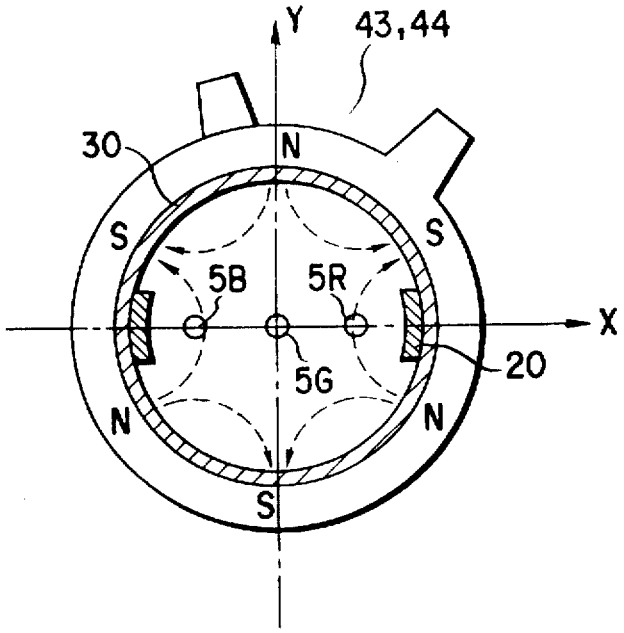
FIG. 14 is a diagram for explaining the operation of a second magnetic member according to the embodiment shown in FIG. 11.

FIG. 14 schematically shows the X-Y section of the six-pole unit constituted by the magnet plates 43 and 44, which is used in the color cathode ray tube of this embodiment at the position where it is arranged, and a magnetic field generated by it. As described above, in this embodiment, the annular magnetic segment 30 is arranged as the second magnetic member on the neck side of the magnet plate portion that generates the magnetic fluxes. Therefore, a non-uniformity in the arranged amounts of the magnetic members as shown in FIG. 10B disappears on the outer circumferential surface of the neck and in the vicinity of the pairs of the magnet plates, and local magnetization will not occur. As a result, a predetermined six-pole magnetic field shape as indicated by broken lines in FIG. 14 can be obtained. In contrast to this, as described above, when the second magnetic member is not arranged, the first magnetic members are magnetized by the magnetic field generated by the six-pole magnet plate unit, as shown in FIG. 10B, and thus the shape of the six-pole magnetic field is disordered.

Table 2 shows the evaluation result of the uniformity of the six-pole magnetic field in terms of the moving amount of the center beam. In Table 2, the moving amount of the center beam is shown with respect to the moving amount of the side beams as 100(%). From Table 2, it is known that the moving amount of the center beam can be improved to about 5%.

TABLE 2

| | Moving Amount of Side Beams (%) | Moving Amount of Center Beam (%) |
|---|---|---|
| Ideal 6-pole Field | 100 | 2 or less |
| This Embodiment | 100 | 5 |
| Prior Art | 100 | 60 |

Figure 15:
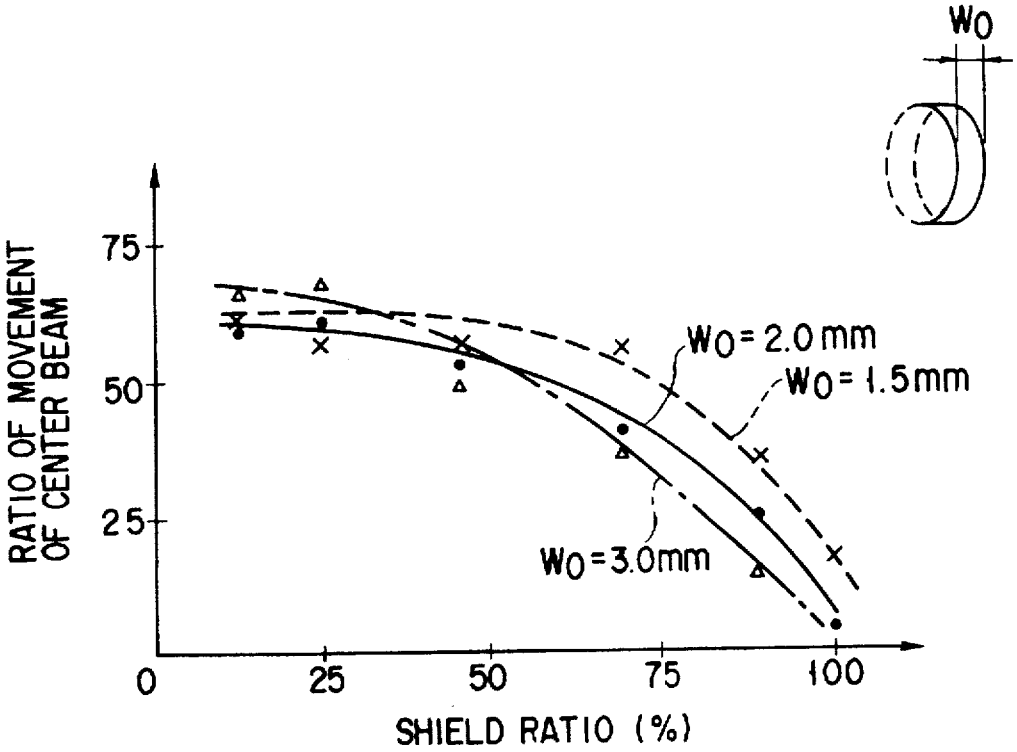
FIG. 15 is a graph for evaluating the relationship between the size of the second magnetic member and the operation, in which this relationship is evaluated in terms of the moving amount of the center beam.

The effect of improving the moving amount of the center beam is influenced by the shield ratio of the annular second magnetic member covering the outer circumferential surface of the neck to the length of the outer circumference of the neck. FIG. 15 shows the graph of various values of a width $W_0$ by plotting the shield ratio along the axis of abscissa and the ratio of the moving amount of the center beam along the axis of ordinate with respect to the second magnetic member, wound to extend on the outer circumferential surface of the neck by one turn to entirely cover it, as a shield ratio of 100%. From FIG. 15, it is known that the higher the shield ratio, the larger the effect. However, even if the second magnetic member does not completely shield, a sufficient effect is recognized with a shield ratio of about 70%.

As described above, according to this embodiment, the first pair of magnetic members are arranged on the opposite sides to the center electron beam with respect to the axes of the two side electron beams. With the arrangement of the first magnetic members, an external magnetic field passing on the outer sides in the direction of the cathode alignment axis and represented by the geomagnetism entering from the panel side of the envelope is concentrated on the magnetic members. Also, the magnetic field passing between the cathode located at the center and cathodes located at the two sides is changed in a direction to be concentrated by the first magnetic members. As a result, generation of a magnetic field component perpendicularly intersecting the electron beam tracks in the vicinity of the cathodes can be suppressed, and generation of the electromagnetic force that operates to move the pair of side beams in the opposite directions is suppressed, thereby suppressing an error in convergence. Furthermore, the second magnetic member is provided on the outer circumferential surface of the neck, thereby balancing the amounts of the magnetic members on the outer circumferential surface of the neck so that the magnetic field generated by the multipole field generating means will not be locally attracted by the first magnetic members.

(Third Embodiment)

The locations of the magnetic members shown in the first and second embodiments are closely related to the geomagnetic shield effect of the magnetic members. If the locations of the magnetic members are not appropriate, the geomagnetic shield effect is decreased, and the effect of maintaining the convergence quality within a predetermined range is decreased.

The first and second embodiments mainly have described a case wherein the first and second magnetic members are provided on the outer wall of the neck. In this case, however, it takes a certain period of working time to mount the magnetic members. Since the working time influences the cost of the color cathode ray tube, a reduction in working time is desired.

An arrangement of a means capable of shortening the working time and having excellent mounting precision will be described.

Figure 16:
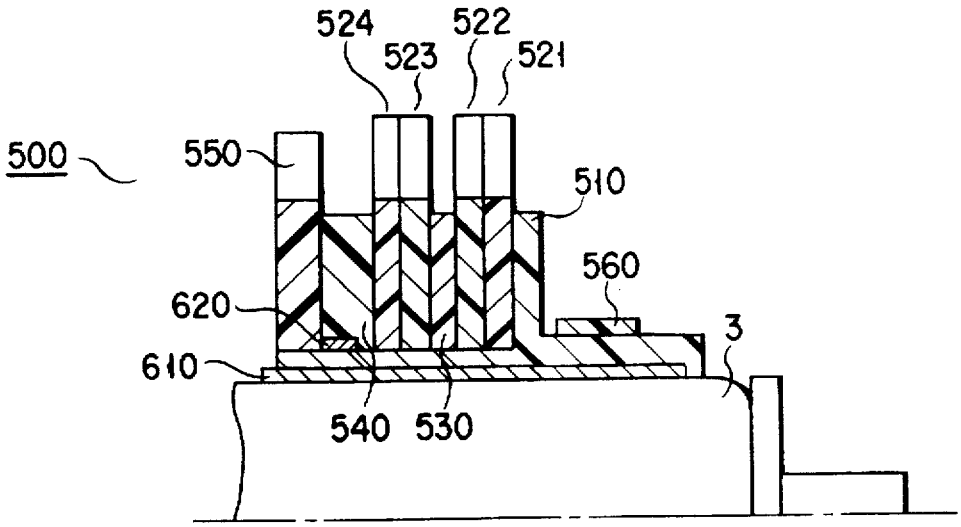
FIG. 16 is a sectional view schematically showing another arrangement of the neck of the color cathode ray tube according to the present invention.
Figure 17:
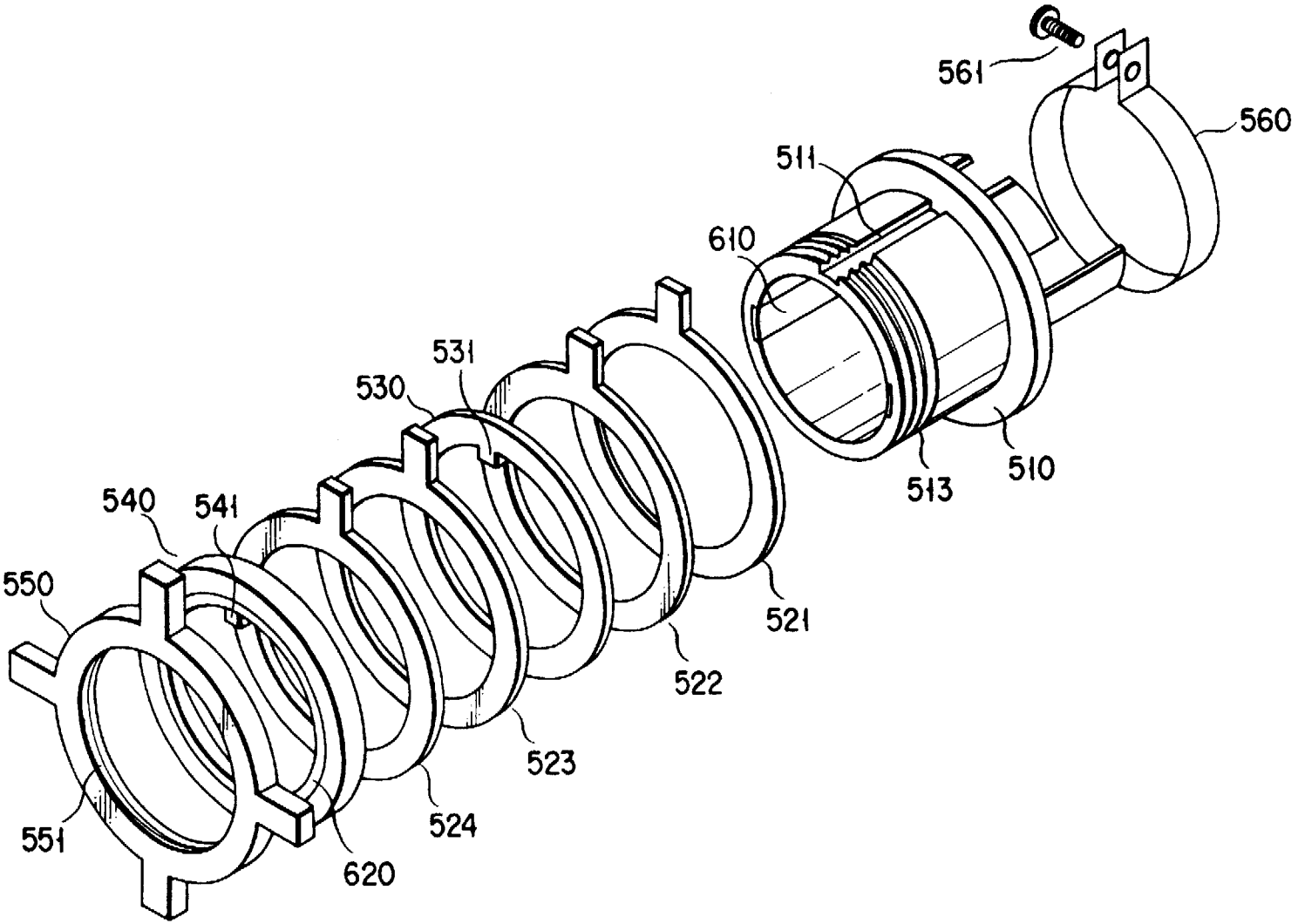
FIG. 17 is an exploded view showing the arrangement of a multipole field generating means shown in FIG. 16.

FIGS. 16 to 19B show views showing the main part of the third embodiment. A color cathode ray tube according to this embodiment has a multipole field generating means at the neck portion. Except for this, the arrangement of this color cathode ray tube is the same as that shown in FIG. 11. FIG. 16 is an enlarged view showing the sectional structure of the multipole field generating means of the neck portion, and FIG. 17 is an exploded view of the structure of the multipole field generating means. A multipole field generating means 500 provided on the outer side of a neck 3 is constituted by a cylindrical holder 510 fitted on the neck, a plurality of annular members mounted on the cylindrical holder 510, and a fixing ring 550 for fixing the plurality of annular members on the cylindrical holder 510.

A groove 511, and an external thread 513 to be fitted with an internal thread 551 of the fixing ring 550 are provided to the outer circumferential surface of the cylindrical holder 510. A first magnetic member 610 is disposed on the inner circumferential surface of the cylindrical holder 510.

The plurality of annular members are constituted by a pair of magnet plates 521 and 522 constituting a four-pole unit that generates a four-pole magnetic field as the first multipole field, a pair of magnet plates 523 and 524 constituting a six-pole unit that generates a magnetic six-pole magnetic field as the second multipole field, a first dividing spacer 530 arranged between the magnet plate 522 of the first pair and the magnet plate 523 of the second pair, and a second dividing spacer 540 located between the magnet plates 524 and the fixing ring 550. The first dividing spacer 530 has almost the same thickness as that of each of the magnet plates 521, 522, 523, and 524, and a projection 531 is formed on the inner circumferential surface of the first dividing spacer 530. The second dividing spacer 540 is thicker than the first dividing spacer 530. A second magnetic member 620 is disposed on the inner circumferential surface of the second dividing spacer 540. A projection 541 is formed on the inner circumferential surface of the second dividing spacer 540 in the same manner as in the first dividing spacer 530. The projections 531 and 541 engage with the groove 511 formed in the outer circumferential surface of the cylindrical holder 510. Thus, rotation of the fixing ring 550 for fixing the positions of the plurality of annular members is prevented from being transmitted to the multipole field generating plates, and the multipole field generating plates can be fixed at predetermined positions.

The multipole field generating unit having the above structure is fixed to the neck 3 by clamping the end portion of the cylindrical holder 510 with a clamp band 560 and a clamp screw 561.

Figure 18:
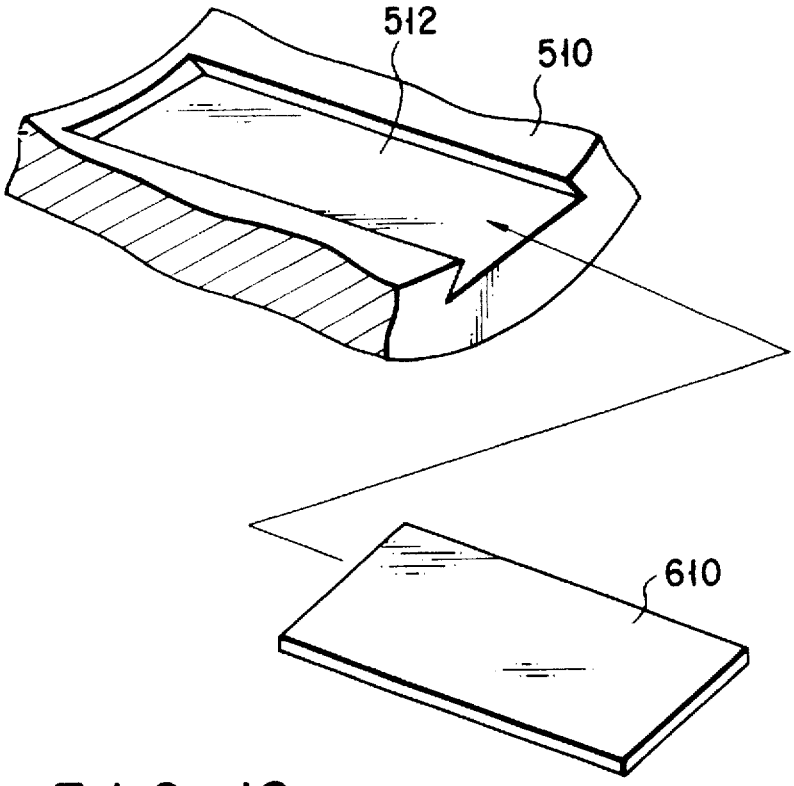
FIG. 18 is a view for explaining the arrangement of the first magnetic member in the multipole field generating means shown in FIG. 17.

The arrangements of the first and second magnetic members will be described in detail. As shown in FIG. 18, a groove 512 having a substantially trapezoidal section is formed in the inner circumferential surface of the cylindrical holder 510. The first magnetic member 610 is inserted in this groove 512 to the end and positioned. A portion of the groove 512 in the vicinity of its end has a decreased width and engages with the first magnetic member 610, thereby facilitating fixing of the first magnetic member 610.

Figure 19A:
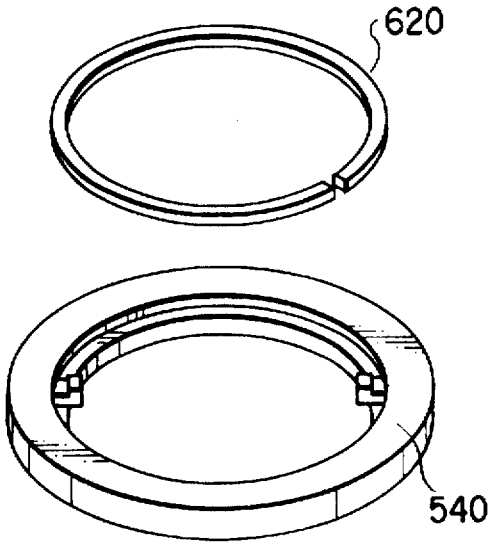
FIGS. 19A and 19B are views for explaining the arrangement of a second magnetic member in the multipole field generating means shown in FIG. 17.
Figure 19B:
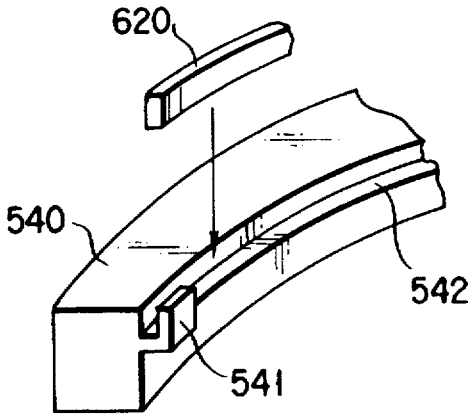

As shown in FIGS. 19A and 19B, the second dividing spacer 540 has a step 542 having a width corresponding to the thickness of the second magnetic member 620, and two projections 541 at its inner circumferential surface. The second magnetic member 620 made of a belt-like magnetic member with a predetermined radius of curvature is mounted at the step 542 portion, as shown in FIG. 19B. At this time, if the belt-like magnetic member is formed to have a length in accordance with the inner circumference of the dividing spacer 540 and a curvature smaller than that of the inner circumferential surface of the dividing spacer 540, is pressed to decrease its diameter, and is thereafter mounted in the dividing spacer, it can be easily disposed by its elasticity. Note that the projections 541 are engaged with the groove 511 formed in the outer circumferential surface of the cylindrical holder 510, as described above, so that they will not be influenced by rotation of the fixing ring 550 and will prevent dropping of the second magnetic member 620.

When the first and second magnetic members are integrally provided to the multipole field generating means in this manner, the mounting operation becomes easy, and a color cathode ray tube that can achieve a stable convergence quality even under different geomagnetic conditions can be easily provided.

In this embodiment, the second magnetic member is disposed in the second dividing spacer 540. However, the second magnetic member can also be provided to another dividing spacer or multipole field generating plates, as a matter of course. Note that since the multipole field generating plates have a small thickness, it is easier to dispose the second magnetic member in a dividing spacer.

The first and second magnetic members are disposed by being fitted in the corresponding grooves. However, it is also possible to fix them in another method, e.g., adhesion, as a matter of course.

The magnetic field generated by the multipole field generating magnet plates is not limited to that described in this embodiment. It suffices if a desired multipole field is generated.

As has been described above, according to the present invention, the influence of the magnetic material used in the electron gun assembly is moderated, and a stable convergence quality can be achieved even under different geomagnetic conditions.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A color cathode ray tube having a tube axis, comprising:

an envelope having a panel;

a phosphor screen formed on an inner surface of said panel of said envelope;

an electron gun assembly opposing said phosphor screen and emitting a plurality of electron beams arranged in a row; and a pair of magnetic members arranged on an outer side of said electron gun assembly at least on an electron beam alignment plane and extending in a direction of the tube axis, wherein a ratio of a width of each of said pair of magnetic members to an outer circumferential length of the neck falls within a range of 2.5% to 10%.

2. A tube according to claim 1, wherein said envelope has a neck incorporating said electron gun assembly, and said magnetic members are provided on an outer circumferential surface of said neck.

3. A tube according to claim 1, wherein said pair of magnetic members have longitudinal sides along the tube axis.

4. A tube according to claim 1, wherein said envelope has a neck continuous to said panel, one of said pair of magnetic members being provided on an outer circumferential surface of said neck.

5. A tube according to claim 1, further including multipole field generating means, mounted on an outer circumferential surface of a neck portion of said panel and having multipole field generating magnet plates for generating a multipole field in a vicinity of said electron gun assembly, said pair of magnetic members being integral to said multipole field generating means.

6. A tube according to claim 5, wherein said multipole field generating means is constituted by at least a cylindrical holder, a plurality of annular multipole field generating magnet plates, and spacers between said magnet plates, and said pair of magnetic members is disposed on said cylindrical holder.

7. A tube according to claim 1, wherein the magnetic members are band-shaped.

8. A color cathode ray tube having a tube axis, comprising:

an envelope having a panel and a neck continuous to said panel;

a phosphor screen formed on an inner surface of said panel of said envelope;

an electron gun assembly opposing said phosphor screen and housed in said neck for emitting a plurality of electron beams arranged in a row;

multipole field generating means, mounted on an outer circumferential surface of said neck and having multipole field generating magnet plates for generating a multipole field in a vicinity of said electron gun assembly;

a first magnetic member arranged on an outer side of said electron gun assembly on an electron beam alignment plane and elongated in a direction of the tube axis; and a second magnetic member arranged in a vicinity of said multipole field generating magnet plates, wherein a ratio of a width of said first magnetic member to an outer circumferential length of the neck falls within a range of 2.5% to 10%.

9. A tube according to claim 8, wherein said envelope has a neck incorporating said electron gun assembly, and said magnetic members are provided on an outer circumferential surface of said neck.

10. A tube according to claim 8, wherein said first magnetic member has a longitudinal side along the tube axis.

11. A tube according to claim 8, wherein said first magnetic member is provided on an outer circumferential surface of said neck.

12. A tube according to claim 8, wherein said first and second magnetic members are integrally provided to said multipole field generating means.

13. A tube according to claim 12, wherein said multipole field generating means is constituted by at least a cylindrical holder, a plurality of annular multipole field generating magnet plates, and spacers between said magnet plates, and said first magnetic member is disposed on said cylindrical holder.

14. A tube according to claim 8, wherein the magnetic members are band-shaped.

* * * * *